US006648056B1

(12) United States Patent
Kaladjian

(10) Patent No.: US 6,648,056 B1
(45) Date of Patent: Nov. 18, 2003

(54) FINGERPRINT JEWELRY

(76) Inventor: Vahe Kaladjian, 101 Utah St., #227, San Francisco, CA (US) 94103

( * ) Notice: Subject to any disclaimer, the term of this patent is extended or adjusted under 35 U.S.C. 154(b) by 0 days.

(21) Appl. No.: 10/140,550

(22) Filed: May 7, 2002

Related U.S. Application Data

(60) Division of application No. 09/371,443, filed on Aug. 10, 1999, now Pat. No. 6,435,255, which is a continuation-in-part of application No. 09/073,120, filed on May 5, 1998, now abandoned.

(51) Int. Cl.[7] ..... B22C 7/02
(52) U.S. Cl. ..... 164/235; 164/246
(58) Field of Search ..... 164/412, 34, 35, 164/45, 235, 246, 516

(56) References Cited

U.S. PATENT DOCUMENTS

| | | | | | |
|---|---|---|---|---|---|
| 964,499 | A | * | 7/1910 | Delabarre | 164/35 |
| 2,183,624 | A | * | 12/1939 | Schwartz | 433/71 |
| 4,508,156 | A | | 4/1985 | Banks et al. | |
| 4,993,472 | A | | 2/1991 | Culver | |
| 5,662,942 | A | * | 9/1997 | Kim, II | 425/2 |
| 6,435,255 | B1 | * | 8/2002 | Kaladjian | 164/35 |

FOREIGN PATENT DOCUMENTS

| | | | | |
|---|---|---|---|---|
| DE | 29 03 728 | * | 8/1980 | A44C/1/00 |
| GB | 2122069 A | | 1/1984 | |
| JP | 409140422 A | | 6/1997 | |

* cited by examiner

*Primary Examiner*—M. Alexandra Elve
*Assistant Examiner*—Kevin P. Kerns

(57) ABSTRACT

A fingerprint jewelry includes any jewelry with a person's fingerprints cast in relief onto its surface. It is made by pressing a finger on a sheet of pliable wax medium to imprint it with fingerprints in relief. In a first embodiment, the wax medium is comprised of a soft wax medium soft enough to be imprinted at room temperature. In a second embodiment, the wax medium is comprised of a soft wax medium supported on a hard wax medium. The imprinted wax medium is positioned in a hollow form. A mold is created around the wax medium by pouring a mold material into the hollow form. An oven is used to harden the mold material and melt away the wax to leave a mold cavity. Molten precious metal is cast into the mold cavity with a casting machine to produce a casting with the fingerprints in relief. The casting is freed by breaking the mold. Additional work may be performed on the casting to produce a finished piece of jewelry. For example, the casting may be bent into a loop and welded closed to form a finger ring. The fingerprint jewelry thus provides a durable, unique, personal, and identifiable representation of the jewelry's giver or owner.

2 Claims, 2 Drawing Sheets

FINGERPRINT JEWELRY

CROSS REFERENCE TO RELATED APPLICATIONS

This is a division of application Ser. No. 09/371,443, filed on Aug. 10, 1999, now U.S. Pat. No. 6,435,255, which is continuation-in-part of application Ser. No. 09/073,120, filed on May 5, 1998, now abandoned.

BACKGROUND OF THE INVENTION

1. Field of the Invention

This invention relates generally to jewelry.

2. Prior Art

Unique jewelry are sometimes designed and fabricated for individual customers. However, most custom jewelry follow conventional styling techniques. Although jewelry with relief portraits are known to provide a unique and identifiable representation of the jewelry's giver or owner, such jewelry are very expensive to produce. They also require a relatively large surface area, so that they are not suitable for small jewelry, such as finger rings or earrings.

A fingerprint jewelry is disclosed in German patent 2903728.It is comprised of a fingerprint cast into a pendant to provide a unique and identifiable representation of the jewelry's giver or owner. However, the disclosed method for making the pendant includes pressing a finger on a heated wax medium, which may be hot enough to cause discomfort, or even burn a finger. The heating must be very carefully controlled to soften the wax enough to take the impression, but not enough to melt it. Such an inconvenience may limit the commercial success of the fingerprint pendant. The wax is disclosed as being contained in a plate, which must be removed before the wax can be cast. The plate must be a metal or porcelain plate to withstand heating, so that the wax, when cooled, cannot be removed from the plate without damaging or destroying the fingerprint. The method disclosed in the German patent is commercially and technically impractical.

OBJECTS OF THE INVENTION

Accordingly, objects of the present fingerprint jewelry are:

- to include a relief fingerprint to provide a truly unique, personal, and identifiable representation of the jewelry's giver or owner at relatively low cost;
- to be small in size, if desired, and still provide an identifiable representation of the jewelry's giver or owner;
- to allow a customer to make a fingerprint on a wax medium without burning the finger; and
- to allow a customer to conveniently make an imprint at home without any specialized equipment.

Further objects of the present invention will become apparent from a consideration of the drawings and ensuing description.

BRIEF SUMMARY OF THE INVENTION

A fingerprint jewelry includes any jewelry with a person's fingerprints cast in relief onto its surface. It is made by pressing a finger on a sheet of pliable wax medium to imprint it with fingerprints in relief. In a first embodiment, the wax medium is comprised of a soft wax medium soft enough to be imprinted at room temperature. In a second embodiment, the wax medium is comprised of a soft wax medium supported on a hard wax medium. The imprinted wax medium is positioned in a hollow form. A mold is created around the wax medium by pouring a mold material into the hollow form. An oven is used to harden the mold material and melt away the wax to leave a mold cavity. Molten precious metal is cast into the mold cavity with a casting machine to produce a casting with the fingerprints in relief. The casting is freed by breaking the mold. Additional work may be performed on the casting to produce a finished piece of jewelry. For example, the casting may be bent into a loop and welded closed to form a finger ring. The fingerprint jewelry thus provides a durable, unique, personal, and identifiable representation of the jewelry's giver or owner.

DRAWING REFERENCE NUMERALS

10. Wax Medium
11. Backing Sheet
12. Finger
13. Stem
14. Base
15. Dish
16. Hollow Form
17. Mold Material
18. Hardened Mold
19. Mold Cavity
20. Conduit
21. Funnel
22. Display Medium
23. Fingerprints
24. Finger Ring
25. Soft Wax Medium
26. Hard Wax Medium

DETAILED DESCRIPTION OF THE INVENTION

FIG. 1

Figure 1:
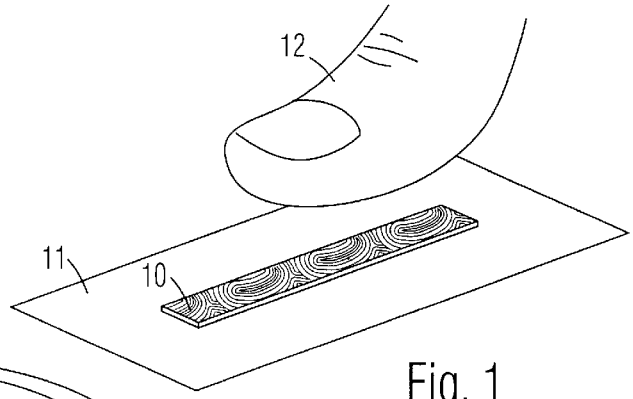
FIG. 1 is a side perspective view of a first embodiment of a wax medium being imprinted with fingerprints.
Figure 2:
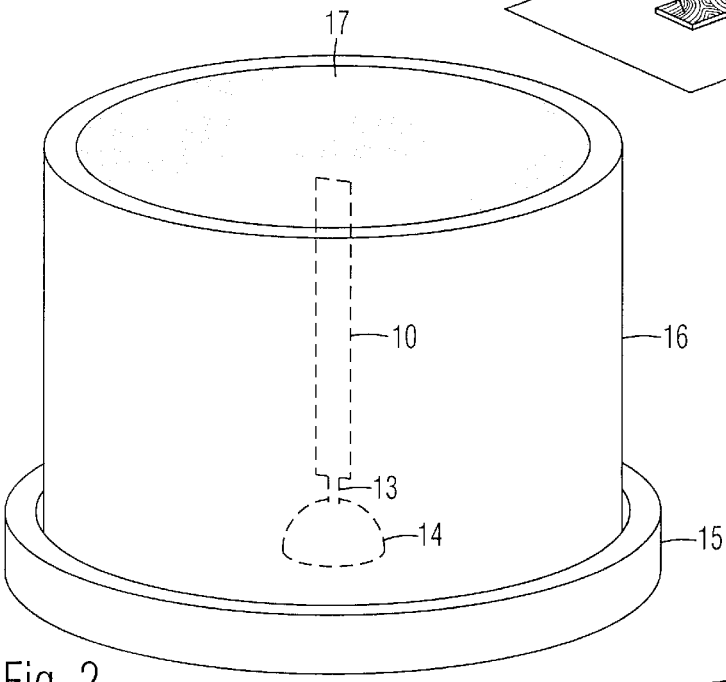
FIG. 2 is a front perspective view of a mold material poured around the wax medium in a hollow form.
Figure 4:
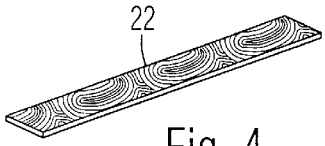
FIG. 4 is a side perspective view of a casting made from the mold.
Figure 5:
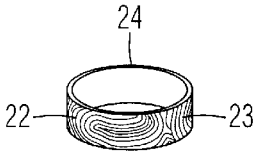
FIG. 5 is a front perspective view of a finished fingerprint jewelry.
Figure 3:
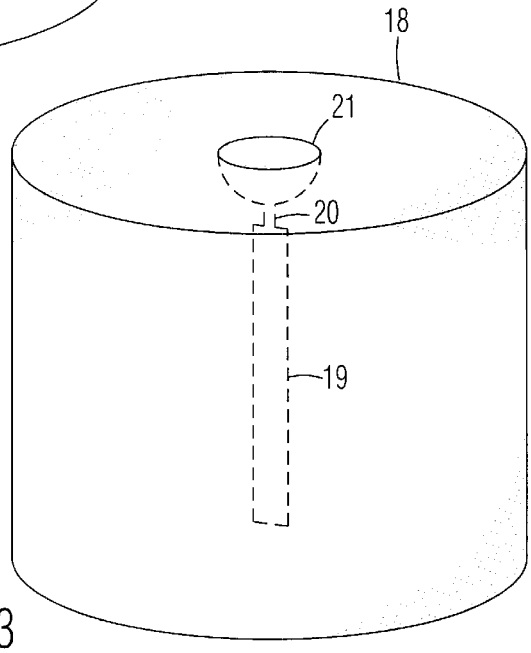
FIG. 3 is a front perspective view of a hardened mold with the wax removed.
Figure 6:
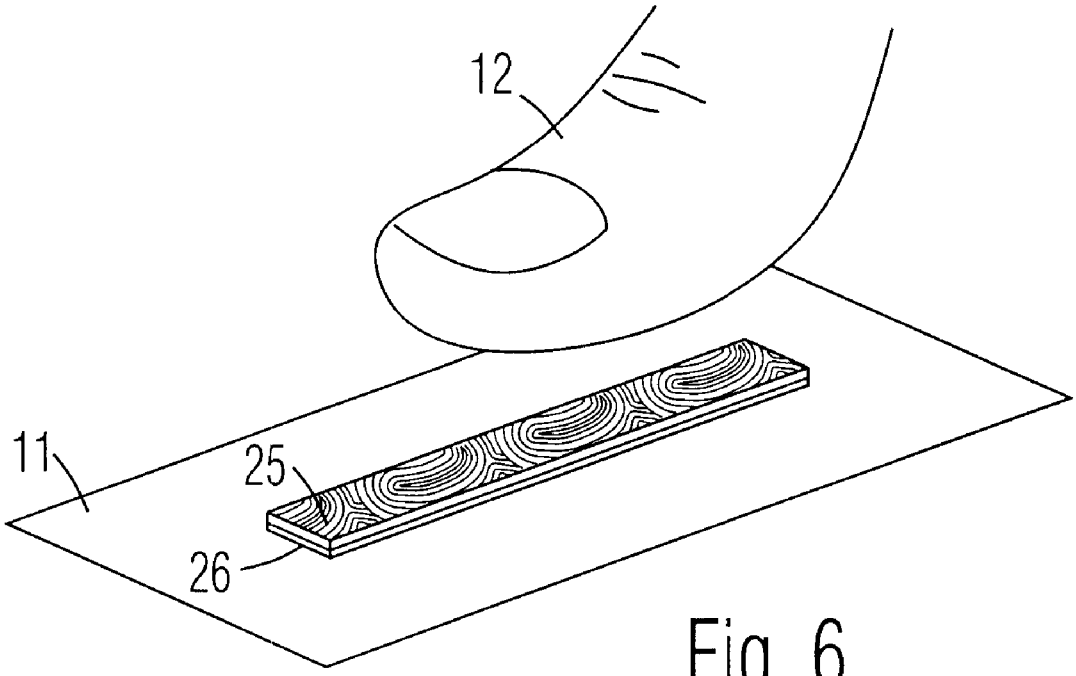
FIG. 6 is a side perspective view of a second embodiment of a wax medium being imprinted with fingerprints.

A first step in the making of the present fingerprint jewelry is shown in the side perspective view in FIG. 1. It includes a pliable wax medium 10 attached to a generally rigid backing sheet 11, such as a cardboard. Although wax medium 10 is shown as a flat rectangular strip suitable for being made into a finger ring, it may be of any shape for being made into any type of jewelry, such as an earring, a bracelet, a pendant, a broach, etc. Wax medium 10, which is preferably a micro-crystalline wax, is soft enough to take a fingerprint impression without being heated, i.e., at room temperature, and is preferably thick enough to maintain its shape after it is removed from backing sheet 11.

A finger 12 of a person, who would typically be the giver or owner of the jewelry, is pressed onto wax medium 10 to impress it with one or more fingerprints in relief, i.e., with sunken grooves and raised ridges. A customer may conveniently place a mail order with a jeweler and receive wax medium 10 and its backing sheet 11 in a box. After wax medium 10 is imprinted with fingerprints, it is returned by mail to the jeweler. Alternatively, the customer may perform the imprinting at a jeweler's premises.

FIG. 2

The remaining steps are preferably performed by a jeweler with suitable skills and equipment. The imprinted wax medium 10 is removed from backing sheet 11 (FIG. 1), and attached to a narrow stem 13 projecting from the top of a base 14, which is supported on a heat resistant dish 15. Both stem 13 and base 14 are preferably made of an easily meltable medium, such as wax. A heat resistant hollow form 16 is positioned around wax medium 10 on dish 15. A liquid mold material 17, which is preferably concrete, is poured into hollow form 16 to embed wax medium 10, wax stem 13, and wax base 14. The whole assembly shown is baked in an oven at a temperature of about 1000° F. to harden mold material 17 and burn away all the wax without residue.

FIG. 3

A hardened mold 18 is removed from the hollow form and dish. A mold cavity 19, a conduit 20, and a funnel 21 are formed by the absence of the wax. A liquefied durable material suitable for use in jewelry, such as molten gold, silver, or platinum, is cast into cavity 19 with a conventional casting machine. The liquid material is allowed to solidify.

FIG. 4

A resultant casting or durable display medium 22 with fingerprints 23 cast in relief is freed by breaking the mold. Excess material formed during the casting process, such as the stem, is trimmed off. Display medium 22 may be cleaned and polished.

FIG. 5

As an example, rectangular display medium 22 is bent into a loop and welded close to form an attaching means or finger ring 24. The weld is smoothed and polished to make it undetectable. Finger ring 24 is one possible type of an attaching means for attaching the fingerprint jewelry to a person. A literal piece of the person is thus easily reproduced as jewelry, which makes a relatively affordable but highly personal memento or gift. Although finger ring 24 is very small, the fingerprints thereon are still easily identifiable.

FIG. 6

An alternative method for making the fingerprint jewelry includes providing a soft wax medium bonded to and supported on top of a hard wax medium 26, which is attached to a generally rigid backing sheet 11, such as a cardboard. Backing sheet 11 is rigid enough to support wax mediums 25 and 26 for transportation and relatively rough handling. A finger 12 of a person, who would typically be the giver or owner of the jewelry, is pressed on soft wax medium 25 to impress it with one or more fingerprints in relief. Although wax medium 25 is shown as a flat rectangular strip suitable for being made into a finger ring, it may be of any shape for being made into any type of jewelry, such as an earring, a bracelet, a pendant, a broach, etc. A customer may conveniently place a mail order with a jeweler and receive wax mediums 25 and 26, and backing sheet 11 in a box. After soft wax medium 25 is imprinted with fingerprints, it is returned by mail to the jeweler for casting. Alternatively, the customer may perform the imprinting at a jeweler's premises.

Soft wax medium 25, which is preferably a microcrystalline wax, is soft enough to be imprinted at room temperature, i.e., without being heated. Since soft wax medium 25 is so soft, it is supported on hard wax medium 26, which is hard enough to maintain the shape of soft wax medium 25 after backing sheet 11 is removed. Hard wax medium 26 is preferably thinner than soft wax medium 25, for example, it may be about the half the thickness. Both soft wax medium 25 and hard wax medium 26 are selected to burn without residue during casting. The combination of soft wax medium 25 and hard wax medium 26 thus provides the important convenience of collecting fingerprints at home without specialized equipment or burning the fingers, so that the fingerprint jewelry may become more commercially successful.

SUMMARY AND SCOPE

Accordingly, the present fingerprint jewelry provides a truly unique, personal, and identifiable representation of the jewelry's giver or owner at relatively low cost. It may be small in size, and still provides an identifiable representation of the jewelry's giver or owner. It allows a customer to make an imprint without burning the finger. It allows a customer to conveniently make an imprint at home without any specialized equipment.

Although the above description is specific, it should not be considered as a limitation on the scope of the invention, but only as an example of the preferred embodiment. Many substitutes and variations are possible within the teachings of the invention. For example, the jewelry does not have to be completely covered with fingerprints, i.e., the display surface or imprinted surface may form only a portion of the jewelry. The finger ring may be made in other styles, such as a flat display surface attached on a plain band. The wax medium may be provided in any shape, and made into any type of jewelry. The backing may be eliminated if hard wax medium is hard enough. Other attaching means, such as a pin, a clip, a chain, etc., may be provided for attaching the fingerprint jewelry to a person. Therefore, the scope of the invention should be determined by the appended claims and their legal equivalents, not by the examples given.

I claim:

1. A relief fingerprint collecting device for making fingerprint jewelry, comprising:

a soft wax medium soft enough when unheated for being impressed with a fingerprint in relief; and a hard wax medium bonded to said soft wax medium; wherein said soft wax medium and said hard wax medium cooperate to form a plurality of wax layers;

said hard wax medium is hard enough when unheated to support said soft wax medium;

said soft wax medium and said hard wax medium are arranged for being embedded in a mold material and burned away without residue for leaving a mold cavity in said mold material.

2. The relief fingerprint collecting device of claim 1, wherein said soft wax medium is comprised of a microcrystalline wax for being easily impressed with said fingerprint.

* * * * *